US005377520A

United States Patent [19]

Thoms et al.

[11] Patent Number: 5,377,520

[45] Date of Patent: Jan. 3, 1995

[54] METHOD AND DEVICE FOR INSERTING SHEET BARS INTO DRAWING TOOLS

[75] Inventors: Volker Thoms, Calw-Hirsau; Ulrich Harthun, Sindelfingen; Stefan Kienzle, Leinfelden-Echterdingen; Klaus Siegert, Sindelfingen, all of Germany

[73] Assignee: Mercedes-Benz AG, Germany

[21] Appl. No.: 109,250

[22] Filed: Aug. 20, 1993

[30] Foreign Application Priority Data

Aug. 21, 1992 [DE] Germany ..... 4227652

[51] Int. Cl.[6] ..... B21D 24/16

[52] U.S. Cl. ..... 72/361; 72/350

[58] Field of Search ..... 72/350, 361

[56] References Cited

U.S. PATENT DOCUMENTS

| | | | |
|---|---|---|---|
| 1,415,838 | 5/1922 | Griffiths et al. | 72/361 |
| 3,106,391 | 10/1963 | Dew . | |
| 3,597,955 | 8/1971 | MacKenzie . | |
| 4,719,787 | 1/1988 | Ragland, Jr. | 72/350 |

FOREIGN PATENT DOCUMENTS

| | | | |
|---|---|---|---|
| 4002324 | 8/1991 | Germany . | |
| 107733 | 6/1984 | Japan | 72/361 |
| 158945 | 6/1992 | Japan | 72/361 |
| 1604291 | 12/1981 | United Kingdom . | |
| 2223973A | 4/1990 | United Kingdom . | |
| 2227697A | 8/1990 | United Kingdom . | |
| 2243134A | 10/1991 | United Kingdom . | |

*Primary Examiner*—Lowell A. Larson
*Attorney, Agent, or Firm*—Evenson, McKeown, Edwards & Lenahan

[57] ABSTRACT

A device and method for inserting sheet bars into drawing tools provides a program controllable sheet bar inserter with a gripper which contains a plurality of suction cups or electromagnets for picking up or setting down a sheet bar. The drawing tool contains a pair of bearing faces which together clamp in the sheet bar during drawing. In order, in particular for complicated bearing faces of the deep-drawing tool, to achieve a uniformly high drawn component quality and avoid rejects due to possible displacement of the sheet bars within the drawing tool as it closes, the gripper is constructed in the form of an at least three legged gripping spider with controllable legs with which the picked-up sheet bar can be deformed in a defined manner during transportation from the picking-up location to the drawing tool and can be matched to the shape of the bearing face of the lower bearing frame. Controllable adhesion elements in the form of suction cups or electromagnets for holding tight a preformed sheet bar which has been inserted and positioned by the gripping spider are provided at a plurality of points in a countersunk fashion into the lower bearing face.

6 Claims, 3 Drawing Sheets

METHOD AND DEVICE FOR INSERTING SHEET BARS INTO DRAWING TOOLS

BACKGROUND AND SUMMARY OF THE INVENTION

The present invention relates to a method for drawing sheet metal components made of sheet bars in a drawing tool which has an upper tool and a lower tool and is drivable in a stroke-executing fashion by a press, in which a sheet bar is removed from a supporting surface and, with the drawing tool opened, placed in a positionally defined fashion on a bearing face of the lower tool. The drawing tool is closed with the application of force and the drawn sheet metal component is subsequently removed from the re-opened drawing tool. The present invention also relates to a device for inserting sheet bars into a drawing tool, the drawing tool containing a die-plate, a drawing punch and a drawing frame, with an upper component of the drawing tool being drivable in a stroke-executing fashion, the drawing tool also containing bearing faces, with an upper bearing face assigned to the upper tool and a lower bearing face assigned to a lower tool, the upper and lower bearing faces together clamping in the sheet bar during drawing. The device includes a sheet bar inserter which has a program-controllable working arm with a gripper attached to an outer end of the working arm, the gripper having a plurality of controllable adhesion elements that are at least one of suction cups and electromagnets that pick up or set down a sheet bar, the adhesion elements being mutually spaced with respect to one another.

German Patent Document 40 02 324 shows a known method and device for inserting sheet bars into drawing tools, and has a gripper with a plurality of controllable suction cups for removing flat oiled sheet bars from a stack of sheet bars and subsequently inserting the removed sheet bars into a deep-drawing tool. Because of the oiling of the sheet bars in order to improve their sliding capacity and deep-drawing capacity, the sheet bars may stick to one another in the stack so that problems may result when removing them individually. By means of gripper-integrated, centrally arranged compression springs, the sheet bar to be removed should initially still be pressed against the stack of sheet bars in the central region using the known gripper and only lifted up in the corner region where the suction cups are arranged in order to ensure that the sheet bars are released and detached reliably. Even though the associated deep-drawing tool is not illustrated or described in greater detail in the aforesaid publication, cooperation between such a removal and detachment device with a deep-drawing press and the drawing tool attached therein can be assumed as known. It is disadvantageous on the known device that the gripped sheet bar which is to be inserted is forcibly pressed into a sagging shape by the action of the compression springs, which shape can spring up in an uncontrolled fashion after the transfer of the sheet bar to the deep-drawing tool. As a result, an exactly reproducible, accurately positioned insertion of the sheet bars into the deep-drawing tool cannot be ensured. This applies all the more for deep-drawing tools in which, as a result of drawing components, complicated bearing faces are present on the bearing frame. As a result of inaccurate depositing of the sheet bars in the deep-drawing tool and/or of uncontrolled movements of the sheet bar itself in the time between the release from the gripper and the closing of the tool, poor drawn component quality, and in an extreme case, rejects can result.

An object of the present invention is to improve the deep-drawing method of the initially described type and the insertion device of the initially described type for sheet bars so that, in particular in the case of complicated bearing faces of the deep-drawing tool, a uniformly high drawn component quality is achieved and rejects due to any kind of displacement of the sheet bars within the drawing tool as it closes are avoided.

This and other objects are achieved by the present invention which provides a method for drawing sheet metal components made of sheet bars in a drawing tool which has an upper tool and a lower tool and is drivable in a stroke-executing fashion by a press. The method comprises removing a sheet bar from a supporting surface, and with the drawing tool opened, placing the sheet bar in a positionally defined fashion on a bearing face of the lower tool. The sheet bar is preformed at least one of before and during the placement of the sheet bar on the bearing face into a shape which approximates the shape of the bearing face. The preformed sheet bar is secured on the bearing face until a closing of the drawing tool, the securing of the sheet bar on the bearing face being by at least one of the weight of the sheet bar, tool-integrated adhesion elements, and retaining elements. The drawing tool is closed with the application of force and then re-opened. The drawn sheet metal component is subsequently removed from the re-opened drawing tool.

The objects are also achieved by an embodiment of the present invention which provides a device for inserting sheet bars into a drawing tool, the drawing tool containing a die-plate, a drawing punch and a drawing frame, with an upper component of the drawing tool being drivable in a stroke-executing fashion, the drawing tool also containing bearing faces, with an upper bearing face assigned to the upper tool and a lower bearing face assigned to a lower tool, the upper and lower bearing faces together clamping in the sheet bar during drawing. The device comprises a sheet bar inserter which has a program-controllable working arm with a gripper attached to an outer end of the working arm. The gripper has a plurality of controllable adhesion elements that are at least one of suction cups and electromagnets that pick up or set down a sheet bar, the adhesion elements being mutually spaced with respect to one another. The gripper is a multi-legged gripping spider with which the picked-up sheet bar can be preformed in a defined manner during transportation from a picking-up location to the drawing tool and matched to a shape of the bearing faces. The gripper has a central body and legs that are pivotably attached to the central body and are placeable in a predetermined basic position in relation to the central body. The adhesion elements are pivotably coupled to an outer end of the legs. The legs have an effective length, corresponding to a distance from a coupling of the legs to the central body to the adhesion elements, that is controllably variable.

By means of forced elastic preforming, approximated to the shape of the bearing face, of the sheet bar which has been picked up already before insertion, this said sheet bar can be inserted quickly and securely even with complicated bearing faces and can be securely fixed to the lower bearing face by adhesion means integrated there so that the sheet bar which has been inserted in a preformed state cannot "jump up" afterwards until the drawing tool is closed. By virtue of the fixing by adhesion elements during the closing of the tool the inserted sheet bars cannot carry out any uncontrolled movements themselves. The sheet bar is consequently clamped in a controlled and exactly reproducible fashion between the two bearing faces of the lower tool and upper tool. As a result, a continuously high drawn component quality is achieved with the insertion of the sheet bars according to the invention and rejects due to possible displacement of the sheet bars within the drawing tool as it closes are avoided.

Other objects, advantages and novel features of the present invention will become apparent from the following detailed description of the invention when considered in conjunction with the accompanying drawings.

DETAILED DESCRIPTION OF THE DRAWINGS

Figure 3:
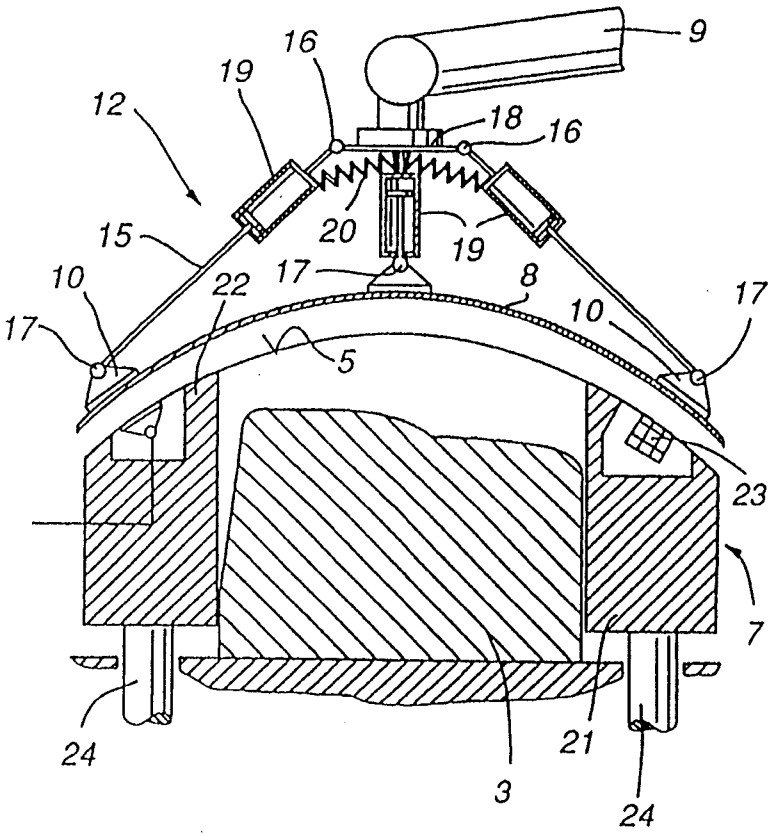
FIG. 3 shows a placing of the preformed sheet bar on the lower bearing frame of a deep-drawing tool of a single-acting press with a drawing device in the platen of the press.
Figure 4:
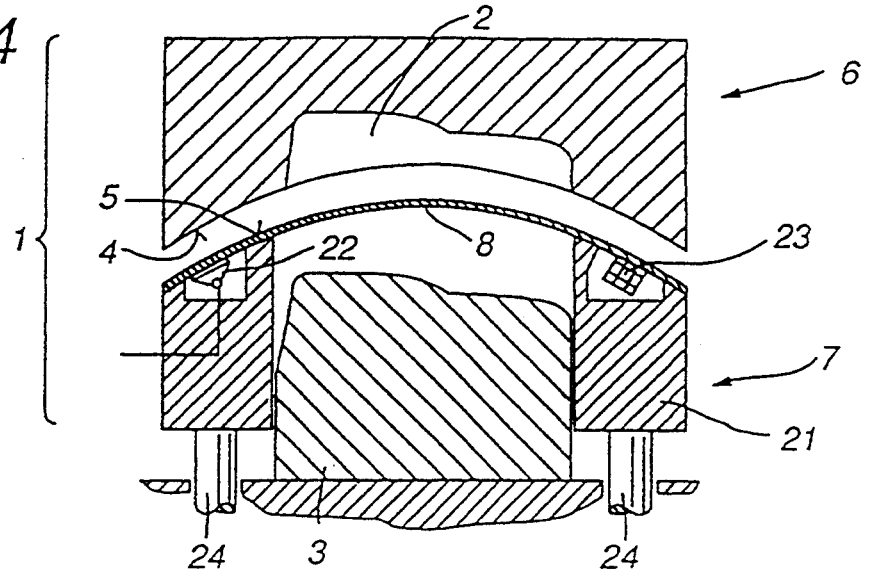
FIG. 4 shows the closing of the deep-drawing tool, the sheet bar being fixed, by adhesion elements integrated in the lower bearing frame, in the preforming state which ensures a clean support, illustrated on the deep-drawing tool for a single-acting press.
Figure 5:
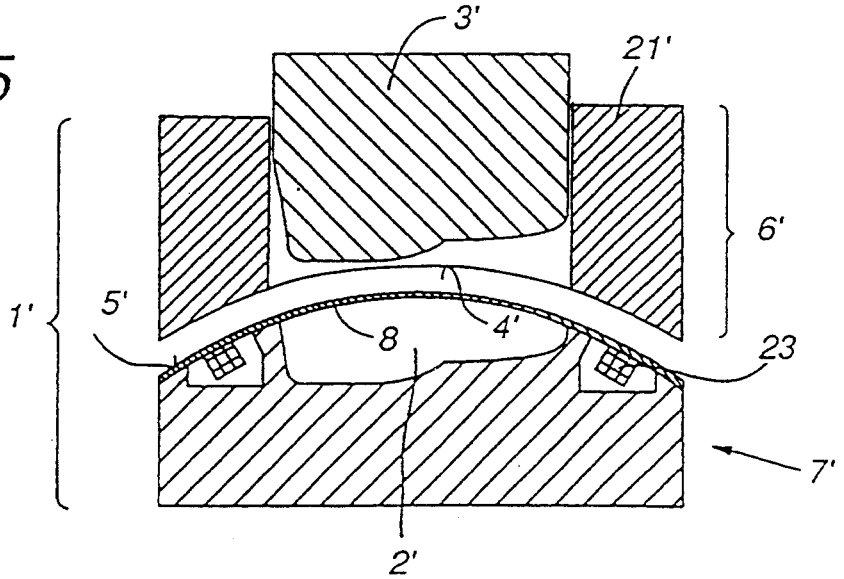
FIG. 5 shows the closing of a deep-drawing tool for a double-acting press, the sheet bar also being fixed on the lower, fixed bearing frame in the inserted preforming state.

In FIGS. 3 and 4, and in FIG. 5, two different deep-drawing tools 1 and 1' are illustrated, these tools each being assigned to different press types, it being possible to realize the present invention for both tool and press types.

In the drawing tool 1 (shown in FIGS. 3 and 4) for single-acting drawing presses, the lower tool 7 is of multi-component construction with a drawing punch 3 and a drawing frame 21 which surrounds the drawing punch 3 and is movably guided with respect to it in the vertical direction. The drawing frame 21 is supported separately by pressure bolts 24 of a drawing device (not illustrated) arranged in the platen of the press. The drawing punch 3 contains on its upper side the die which corresponds to the desired drawn component, whereas the die-plate 2 which is attached in the single-component upper tool contains the drawn-component die which is negative with respect thereto. The lower bearing face 5 on which the sheet bar is placed is formed as a function of the desired drawn-component die on the basis of experience. The bearing face 4, lying opposite, of the upper tool component is formed to be equidistant from the bearing face 5. The sheet bar is clamped in between the two bearing faces 4 and 5 during deep drawing so that the metal sheet can be drawn without folds and, by virtue of a defined subsequent sliding out of the clamping face gap, without fracturing from the drawing punch 3 into the die-plate 2.

The drawing tool 1' (shown in FIG. 5) is provided for double-acting drawing presses. Here, the upper tool 6' is of multi-component construction with a drawing punch 3' and an upper drawing frame 21' which surrounds the drawing punch 3' and is movably guided in the vertical direction, both components being drivable in a stroke-executing fashion in each case by means of a separate drive of the press (which is however not illustrated). The drawing punch 3' contains on its underside the die corresponding to the desired drawn component whereas the die-plate 2' attached in the lower tool 7', which is single-component here, contains the drawn-component punch which is the negative thereof. Lower and upper bearing faces 5' and 4' which are respectively negatives of one another are also attached in the drawing tool according to FIG. 5 in both tool components 6' and 7', the sheet bar being clamped in between the faces 5' and 4' during deep drawing.

When drawing sheet metal components, a sheet bar 8 is usually inserted into the opened drawing tool 1 and 1' For this purpose, the sheet bar 8 is removed from a flat supporting surface, in the illustrated exemplary embodiment from a stack 13 of sheet bars on which the sheet bars lie ready in a positionally defined fashion. The sheet bars are placed, with the drawing tool 1 and 1' opened, in a positionally defined fashion on the bearing lace 5 and 5' of the lower tool 7 and 7'. The drawing tool is then closed with the application of force and subsequently the sheet bar is shaped to produce the desired drawn component. The drawn component is subsequently removed from the reopened drawing tool.

In order to achieve a uniformly high drawn component quality even with complicated bearing faces 4/5 and 4'/5' of the deepdrawing tool and to be able to avoid rejects due to possible displacement of the sheet bars within the drawing tool as it closes, the sheet bar 8 is preformed, before being placed on the lower bearing face 5 and 5', into a shape which approximates the shape of the face, and is positioned in this state on the lower bearing face and fixed until the closing of the drawing tool 1 and 1' by adhesion elements integrated there.

Figure 7:
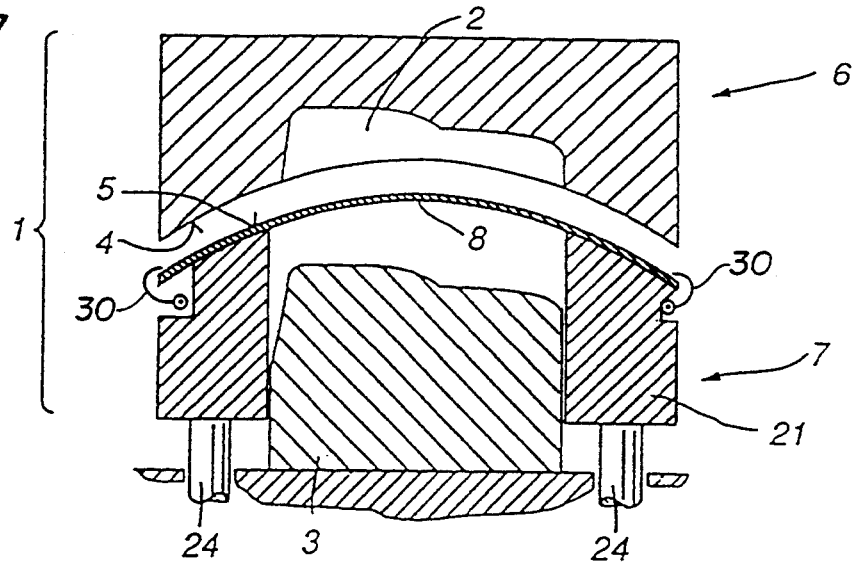
FIG. 7 shows another exemplary embodiment in which the controllable retaining elements are pivotable.

Depending on the design of these adhesion or retaining elements, this fixing of the sheet bar can take place in different ways. In the illustrated embodiment of FIG. 7 controllable retaining elements which are arranged in the lower bearing face are constructed as pivotable hooks 30 which engage positively over the edge of the sheet bar and disappear in a pivoted-back state at least to a large degree under the surface of the bearing face. The sheet bar which has been forcibly fitted tightly against the lower bearing face can also be fixed by means of suction cups 22 or electromagnets 23 which are received in the lower bearing face 5 and 5' and engage frictionally against the surface of the sheet bar.

With an automated or mechanized press feed, a mechanical sheet bar inserter is used which has a program-controllable working arm 9 with gripper which is movably attached to its outer end and contains a plurality of controllable adhesion elements 10, for example in the form of suction cups or electromagnets for picking up or setting down the sheet bar 8. These elements 10 are arranged with mutual spacing with respect to one another. For mechanized, automatic preforming of the sheet bar after its picking up by the preferably flat preparation supporting surface, the gripper is constructed in the form of an at least three-legged gripping spider 12. Thus, the picked-up sheet bar 8 can be preformed in a defined manner during transportation from the picking-up location to the drawing tool 1 and 1' and can be matched to the shape of the bearing faces 5 and 5'. In fact, in the case of the gripping spiders shown in the exemplary embodiments there are a total of three legs 15 provided, two of which are assigned to one of the edges of the sheet bar and one to the center of the sheet bar.

Figure 1:
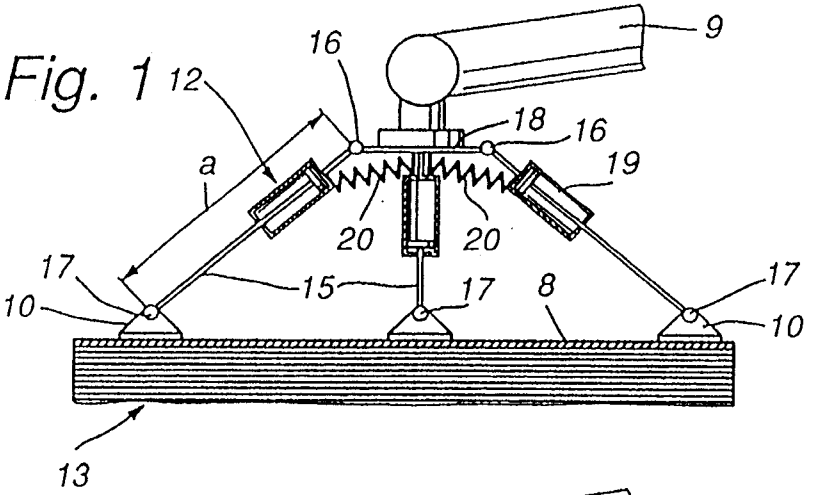
FIG. 1 shows a first exemplary embodiment constructed in accordance with the present invention of a controllable gripper when picking up a sheet bar.
Figure 2:
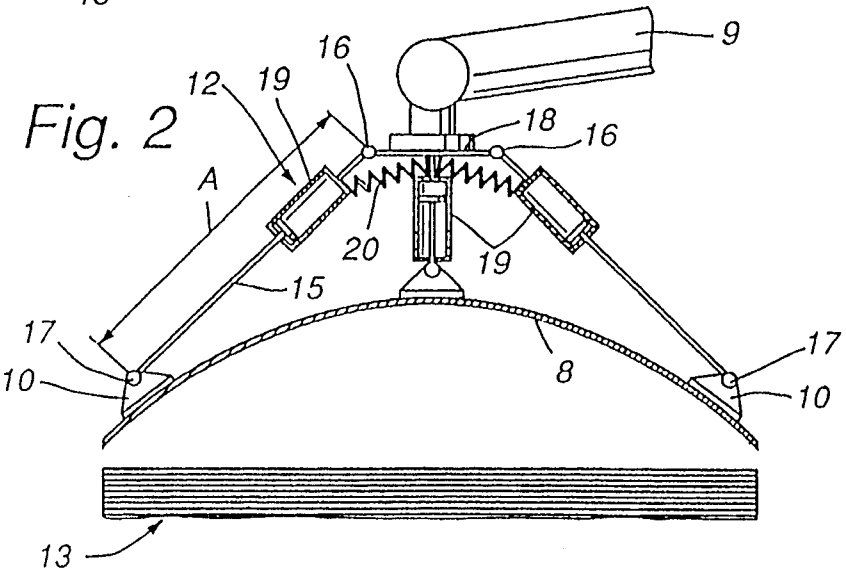
FIG. 2 shows the preforming of the sheet bar by the controllable gripper according to FIG. 1 after picking up.
Figure 6:
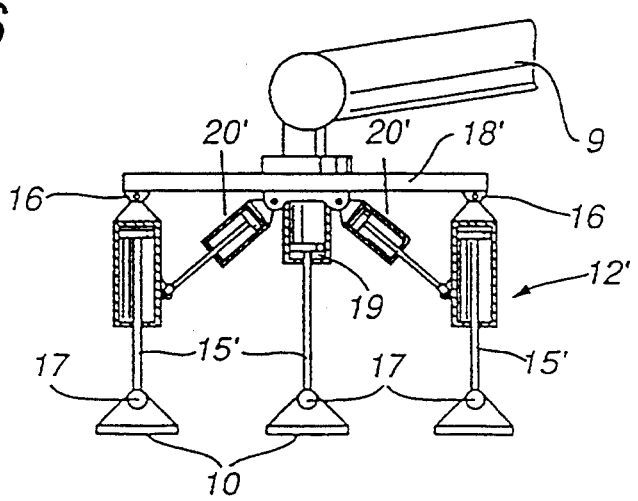
FIG. 6 shows another exemplary embodiment constructed in accordance with the present invention of a controllable gripper illustrated individually.

The outer legs 15 of the gripping spider are pivotably attached to a central body 18 via a joint 16. In the exemplary embodiment shown in FIGS. 1 to 3, the outer legs 15 are held in the unloaded state against folding down under the force of gravity by the force of in each case one spring 20 in a basic position in relation to the central body 18. In the exemplary embodiment, shown in FIG. 6, of a gripping spider 12', this function is assumed by hydraulically actuable cylinders 20'. The spider leg 15' assigned to the center of the sheet bar 8 is attached unmovably to the central body 18 and 18' in both examples shown, which is only possible for preforms for the sheet bar which are mounted in a relatively simple manner and are approximately symmetrical. In the event that the sheet bar has to be inserted in a highly unsymmetrically preformed state, the central spider leg would also have to be movably coupled to the central body and also pivotably connected to the associated adhesion element 10. The adhesion elements 10 are coupled in a spatially pivotable fashion to the outer end of the legs via a ball-and-socket joint 17. The effective length of the legs, i.e. the distance A or a from the body-side joint 16 to the adhesion element 10 can also be varied and controlled in this respect, which, in the exemplary embodiments illustrated, is brought about by a telescopic design of the legs in the manner of piston/cylinder units. In fact, both the function of the telescopic guidance of the movable components of a leg 15 and the movement drive for them are brought about by in each case one lifting cylinder 19 which can be actuated by fluid, preferably hydraulically, via which lifting cylinder 19 in each case one exactly predeterminable length can be set at the leg 15. In the case of a pneumatically actuable lifting cylinder, the extension length of the piston must be set mechanically on a case-by-case basis.

In the empty state of the gripping spider, the lengths of the legs 15 and their angular position with respect to the direction of gravity are set in such a way that the adhesion elements 10, which are attached at the lower end to the legs, lie with their working faces all in a horizontal plane. The gripping spider 12 according to FIGS. 1 to 3, the angular position necessary for this can be adjusted for example by means of corresponding prestressing of the springs 20. In the gripping spider 12' according to FIG. 6, the angular position of the legs can be set directly in a hydraulic fashion. In the case of adhesion elements 10, lying in a horizontal plane, of the gripping spider 12 and 12', the gripping spider 12, 12' can be lowered onto the prepared sheet bar 8, in which case it must be ensured that the adhesion elements of the individual legs come to rest in an exactly positioned fashion within the surface of the sheet bar at the positions conceived for them. After activation of the gripper-side adhesion elements, the sheet bar can be lifted off from the preparation supporting surface, in which case initially only the sucker of an individual corner of a sheet bar is raised in order to facilitate detachment so that this corner becomes reliably released from the sheet bar lying below it when the sheet bar is otherwise resting flat on the stack.

After the removal of the sheet bar from the stack it is placed in the desired preform on the way to the drawing tool to be charged. For this purpose, the legs of the gripping spider are retracted in each case into a separate, previously determined new length. For example, the two outer legs are extended and the central leg shortened so that the sheet bar is given an arched shape. In this forced preform, approximated to the shape of the bearing faces of the drawing tool to be charged, the sheet bar is transferred to the lower bearing face 5 and 5' of the opened drawing tool. By activating the adhesion or retaining elements integrated at the lower bearing face 5, 5', the transfer shape of the sheet bar can be ensured there and maintained until the drawing tool closes. After the deactivation of the gripper-side adhesion elements, the gripper spider can be removed from the region of the drawing tool and the drawing process can be initiated. In some cases where there is a slight simple arching of the bearing face, the intrinsic weight of the sheet bar may be sufficient to preserve exactly reproducible contact which is adequate for a satisfactory drawing result and in a manner which is resistant to slipping. In fact, these are bearing shapes which the sheet bar does not assume automatically as a result of its own weight alone when being set down or into which the sheet bar does not 'drop" due to its own weight but which, however, are readily retained after being set down as a result of the force of gravity when the sheet bar has been initially artificially arched into this bearing shape.

The advantage of the preshaped insertion of the sheet bars consists in the fact that uncontrolled movements of the sheet bar itself within the drawing tool as it closes are avoided and an exact, optimum position therein can be uniformly ensured. Low quality properties on the drawn components or even rejects due to this can thus be eliminated.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method for drawing sheet metal components made of sheet bars in a drawing tool which has an upper tool and a lower tool and is drivable in a stroke-executing fashion by a press, comprising:

removing a sheet bar from a supporting surface;

with the drawing tool opened, placing the sheet bar in a positionally defined fashion on a bearing face of the lower tool;

preforming the sheet bar at least one of before and during the placement of the sheet bar on the bearing face into a shape which approximates the shape of the bearing face, said preforming including mechanically forcing the sheet bar into said shape using an inserting tool;

securing the preformed sheet bar on the bearing face until a closing of the drawing tool, the securing of the sheet bar on the bearing face being by at least one of tool-integrated adhesion elements and retaining elements;

closing the drawing tool with the application of force;

re-opening the drawing tool; and subsequently removing the drawn sheet metal component from the re-opened drawing tool.

2. A device for inserting sheet bars into a drawing tool, the drawing tool containing a die-plate, a drawing punch and a drawing frame, with an upper component of the drawing tool being drivable in a stroke-executing fashion, the drawing tool also containing bearing faces, with an upper bearing face assigned to the upper tool and a lower bearing face assigned to a lower tool, the upper and lower bearing faces together clamping in the sheet bar during drawing, the device comprising:

a sheet bar inserter which has a program-controllable working arm with a gripper attached to an outer end of the working arm, the gripper having a plurality of controllable adhesion elements that are at least one of suction cups and electromagnets that pick up or set down a sheet bar, the adhesion elements being mutually spaced with respect to one another;

wherein the gripper is a multi-legged gripping spider with which the picked-up sheet bar can be preformed in a defined manner during transportation from a picking-up location to the drawing tool and matched to a shape of the bearing faces, the gripper having a central body and legs that are pivotably attached to the central body and are placeable in a predetermined basic position in relation to the central body, the adhesion elements being pivotably coupled to an outer end of the legs, the legs having an effective length, corresponding to a distance from a coupling of the legs to the central body to the adhesion elements, that is controllably variable;

further comprising at least one of adhesion and retaining elements received in a countersunk fashion in the lower bearing face, said at least one of adhesion and retaining elements being controlled at a plurality of points and holding tight a preformed sheet bar which has been inserted and positioned by the gripping spider.

3. Device according to claim 2, wherein the legs of the gripping spider change lengths in a telescopic manner.

4. Device according to claim 2, wherein the legs of the gripping spider are settable in specific angular positions.

5. Device according to claim 2, wherein the controllable adhesion elements which are countersunk in the lower bearing face are at least one of suction cups and electromagnets which engage frictionally on a surface of the sheet bar.

6. Device according to claim 2, wherein the controllable retaining elements which are countersunk in the lower bearing face are pivotable hooks which engage positively over an edge of the sheet bar.

* * * * *